US005300742A

United States Patent [19]

Huang

[11] Patent Number: 5,300,742

[45] Date of Patent: Apr. 5, 1994

[54] WATERPROOF STRUCTURE FOR COMPUTER KEY SWITCH

[76] Inventor: Hai-Long Huang, 12 Fl., No. 215, Chung Shan Road, Section 2, Chung Ho City, Taipei Hsien, Taiwan

[21] Appl. No.: 948,576

[22] Filed: Sep. 23, 1992

[51] Int. Cl.[5] ..... H01H 13/06

[52] U.S. Cl. ..... 200/302.002; 200/302.001

[58] Field of Search ..... 200/302.2, 302.1, 341, 200/345, 302.3, 512

[56] References Cited

U.S. PATENT DOCUMENTS 4,471,189 9/1984 Bacon et al. ..... 200/302.2
5,172,805 12/1992 Gumb ..... 200/302.2
5,199,556 4/1993 Lee ..... 200/345

*Primary Examiner*—Henry J. Recla
*Assistant Examiner*—David J. Walczak
*Attorney, Agent, or Firm*—Morton J. Rosenberg; David I. Klein

[57] ABSTRACT

The present invention relates to a waterproof structure for computer key switch, especially a waterproof structure which comprising an upper protective cap and a lower protective cap, wherein the upper protective cap protecting the part of the computer key switch above the printed circuit board, the post of the computer key can be inserted into a fitting hole of the upper protective cap, the inner wall of the fitting hole contacting tightly with the post of the computer key, the lower protective cap covering the part of the computer key under the printed circuit board, therefore the whole computer key switch can be protected by the waterproof structure so as to prevent water or dust from penetrating into the computer key switch, when inserting the post into the fitting hole of the upper protective cap, the fitting hole can be supported with a leading mold so as to provide a quick inserting method.

2 Claims, 3 Drawing Sheets

WATERPROOF STRUCTURE FOR COMPUTER KEY SWITCH

BACKGROUND OF THE INVENTION

1. Field of the Invention

This invention pertains to waterproof structures for waterproofing computer keyboard switches and protecting them from the surrounding environment. In particular, this invention relates to a waterproof structure which includes an upper protective cap having an arcuate face portion insertable within a key and surrounding a computer key post in watertight relation. Further, this invention pertains to a deformable portion of a protective cap to bear on an inner surface of a key member to increase the restorative forces after the computer key is pressed.

2. Prior Art

Referring to the structure of prior art computer key switches, such may be divided into four basic types. The first type is a mechanical system which is actuated by a generally metallic elastic member. The second type is capacitive in nature which can generate an on/off decision by changing the electrical capacity of a contact diode. The third type is a thin-film system which uses photographic technology to spread silverized glue on a halftone to generate a conductive circuit. The fourth type is a rubber system which is coated with a layer of carbonized conductor material with the rubber key connected to a printed circuit board. The characteristic of the above four computer key switch types are described as follows: The mechanical type applies the electric conductivity of metal to conduct which has an advantageous touching feel for the user. The capacitive type has a lower manufacturing cost, however, its quality is unstable. As to the rubber type, its size can be controlled easily, however, its use causes a serious pollution problem. The above four types all have a common fault, in that they fail to provide an effective waterproof structure for an associated keyboard switch. Thus, the design of the waterproof structure of a computer key switch is of major importance. At present, there are some kinds of computer key switches with waterproofing structures, however, they still have two major faults: (1) they only have a short-term and partial waterproof capability; and, (2) computer keys are enclosed with thick rubber plates which affect the appearance of the computer keys and causes inconvenient operation resulting in increased manufacturing costs.

SUMMARY OF THE INVENTION

It is therefore an object of this invention to provide an upper protective cap and a lower protective cap which can cover the whole computer key switch so as to prevent water from penetrating into the computer key switch.

It is a further object of this invention to provide an upper protective cap and a lower protective cap which are made of soft waterproof film which doesn't affect the key pressing operation and increases the pressing elasticity to restore the key to its original position subsequent to use.

DESCRIPTION OF THE PREFERRED EMBODIMENT

Figure 1:
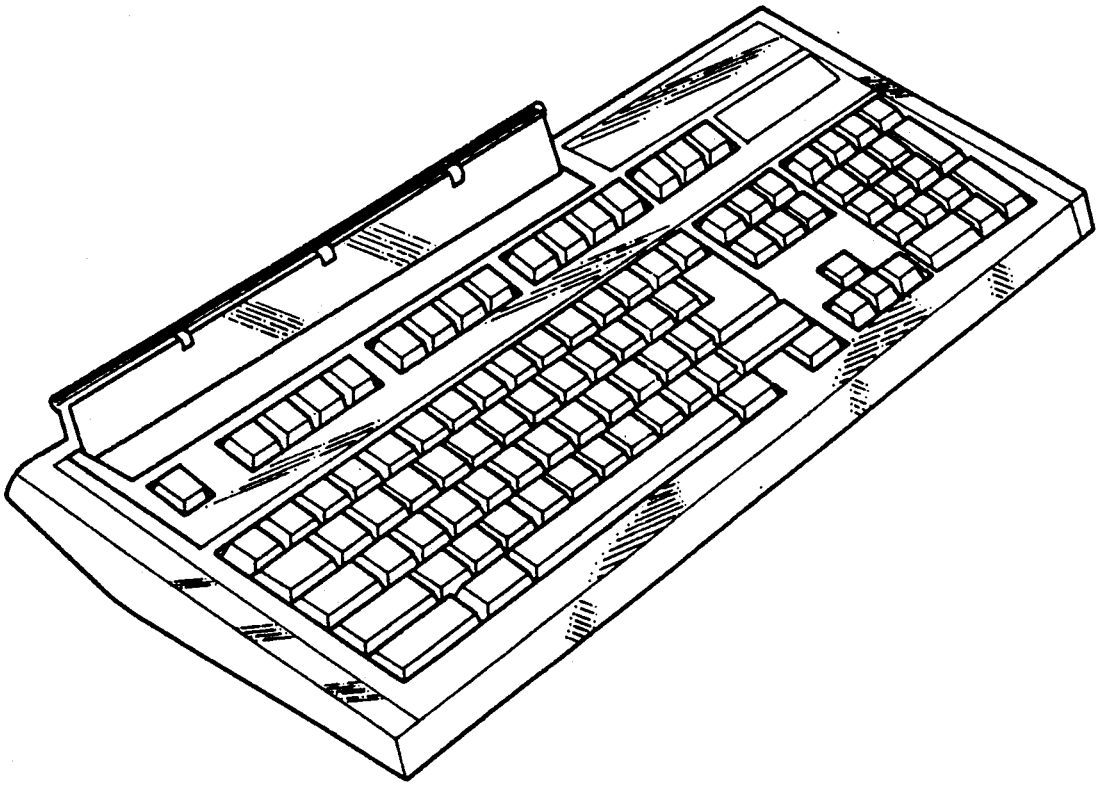
FIG. 1 is a perspective view of a computer keyboard.
Figure 2:
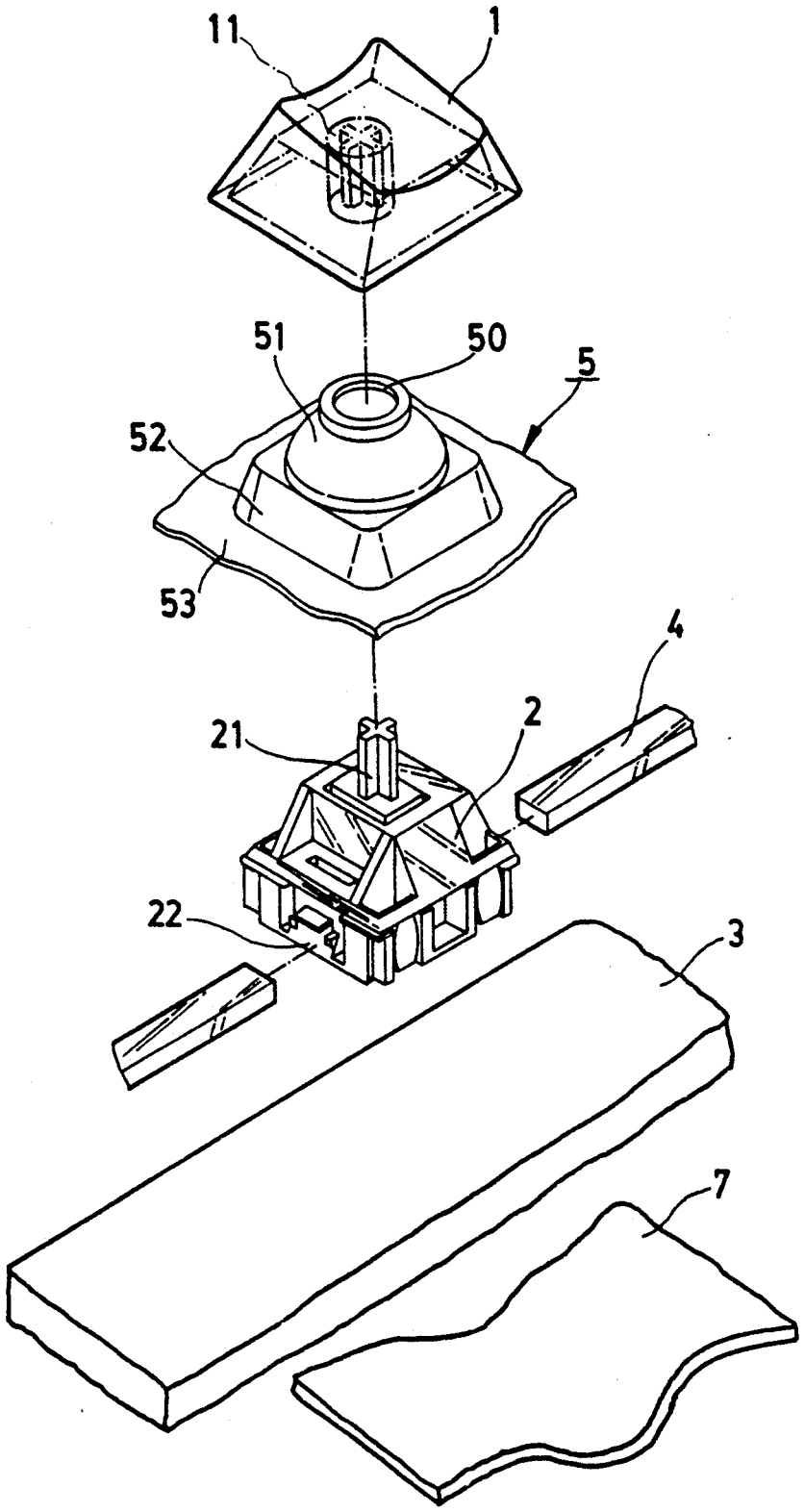
FIG. 2 is an exploded view of the subject waterproof structure for a computer key switch showing the invention concept.
Figure 3:
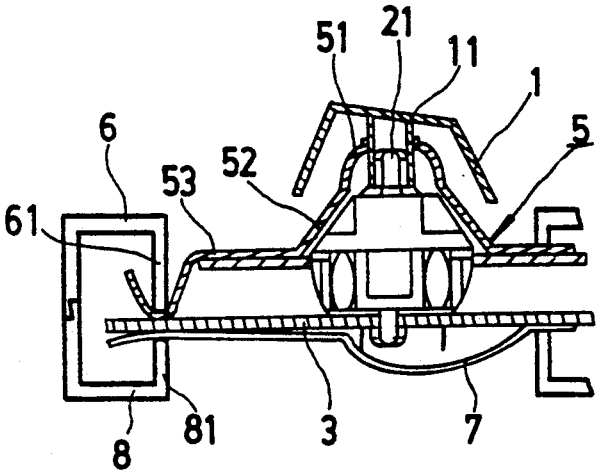
FIG. 3 is a sectional view illustrating the computer key structure of this invention in an unpressed state.

Referring now to FIGS. 2 and 3, this invention comprises a computer key 1, a computer key switch 2, a printed circuit board 3, a fixing plate 4, an upper protective cap 5 and a lower protective cap 7. The computer key 1 has a post 11 formed internal thereto with the post 11 having a cruciform shaped opening for insert of a sliding post 21. The sliding post 21 being installed on the computer key switch 2 and can be force fit into the cruciform shaped opening formed in the post 11. The computer key switch 2 is connected with the printed circuit board 3 at the lower part of the computer key switch 2 and has a fixing groove 22.

Figure 4:
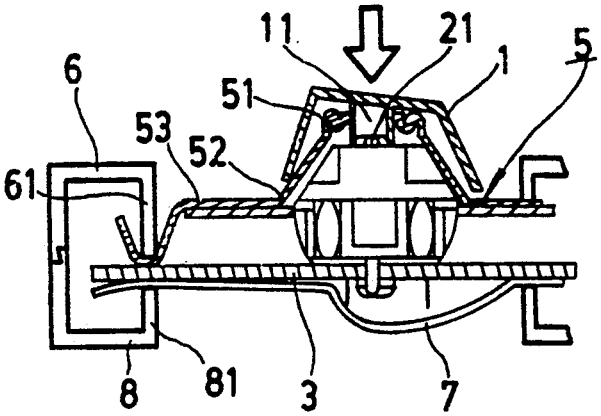
FIG. 4 is a sectional view illustrating the computer key structure of this invention in a pressed state; and, FIG. 5 is a sectional elevational view illustrating the insertion of an upper protective cap by means of a leading mold.

The fixing plate 4 is inserted into the fixing groove 22 to securely couple the computer key switch 2. The upper protective cap 5 includes an arcuate face portion 51, an inclined face portion 52, and a bottom portion 53. The top of the arcuate face portion 51 includes a fitting hole 50 whose inner wall tightly contacts the post 11 so as to prevent water or dust from penetrating into the computer key switch 2. The inclined face portion 52 interfaces with the bottom part of the computer key 2. The assembled post 11 and sliding post 21 is covered with the arcuate face portion 51 and when the computer key 1 is pressed downward, the arcuate face portion 51 will deform inwardly as shown in FIG. 4. The arcuate face portion 51 is very thin and doesn't affect the pressing action of the computer key 1 and increases the pressing elasticity. The bottom portion 53 of the upper protective cap 5 is fixed on the printed circuit board 3 by a first hold-down strip 61 of the computer upper cover 6. The lower protective cap 7 protects the bottom part of the computer key switch 2 under the printed circuit board 3. An edge of the lower protective cap 7 is fixed by a second hold-down strip 81 of the computer lower cover 8.

Figure 5:
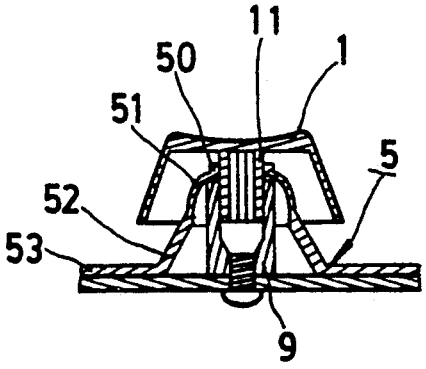

The upper protective cap 5 and the lower protective cap 7 both are made of an elastic material. The fitting hole 50 of the arcuate face portion 51 must contact tightly with the assembled post 11 and sliding post 21. Because the arcuate face portion 51 is very soft and does not have any support when inserted into the fitting hole 50, a leading mold 9 is designed for solving this problem. The leading mold 9 is made of metal or hard material. Referring to FIG. 5, the height of the leading mold is the same as the height of the upper protective cap 5 and the top of the leading mold 9 supports the fitting hole 50. Thus, the post 11 can be inserted into the fitting hole 50 easily.

The characterizations of this invention are described as follows:

(1) The waterproof structure is secure and simple by way of construction with the manufacturing costs decreased over the prior art systems;

(2) The waterproof structure has excellent waterproof effectiveness; and, (3) The waterproof structure reinforces and aids the pressing elasticity of the computer key.

What is claimed is:

1. A waterproof structure for a computer key switch comprising:

(a) a computer key having a cap contour forming a computer key chamber and an internal base surface, said computer key having a computer key post secured to said internal base surface extending therefrom internal said computer key chamber, said computer key post having a cruciform contoured passage extending throughout an extended length thereof;

(b) a printed circuit board;

(c) a computer switch mounted between said printed circuit board and said computer key, said computer switch having a sliding post for sliding mating engagement within said cruciform contoured passage of said computer key post;

(d) an upper protective cap formed of a waterproof and elastic material composition, said upper protective cap defining an upwardly extending arcuately contoured face portion, a bottom portion, and an inclined portion joining said arcuately contoured face portion and said bottom portion, an upper surface of said arcuately contoured face portion having an opening passing therethrough defining an opening inner wall for tightly engaging said computer key post, said inclined portion covering a bottom section of said computer key switch, said arcuately contoured face portion upper surface for deformably contacting said internal base surface when said computer key is displaced thereby providing increased restorative force applied to said computer key subsequent to said displacement;

(e) a lower protective cap formed of a waterproof and elastic material composition for covering a portion of said computer key switch under said printed circuit board;

(f) a first hold-down strip for securing said bottom portion of said upper protective cap to said printed circuit board; and, (g) a second hold-down strip for securing an edge of said lower protective cap to said printed circuit board whereby in combination said upper protective cap and said arcuately contoured face portion in tight engagement with said computer key post covers said computer key switch in watertight relation above said printed circuit board and said lower protective cap covering said portion of said computer key switch under said printed circuit board to form a water and dust proof environment for said computer key switch.

2. The waterproof structure for a computer key as recited in claim 1 wherein said opening passing through said arcuately contoured face portion is dimensioned to receive a leading mold member on an inner surface of said arcuately contoured face portion for supporting said arcuately contoured face portion when said computer key post is inserted on said sliding post.

* * * * *